United States Patent [19]

Schellenberg

[11] 4,016,807

[45] Apr. 12, 1977

[54] BOX AND METHOD OF COVERING A BOX EDGE

[75] Inventor: Walter Schellenberg, Diepoldsau, Switzerland

[73] Assignee: Max Sandherr AG, Switzerland

[22] Filed: Apr. 6, 1976

[21] Appl. No.: 674,105

[30] Foreign Application Priority Data

Apr. 23, 1975 Switzerland ..... 5163/75

[52] U.S. Cl. ..... 93/39 C; 53/42; 53/184 S; 93/55.1 R; 156/69; 156/85; 156/216; 229/5.5; 229/42

[51] Int. Cl.[2] ..... B31B 1/00

[58] Field of Search ..... 53/16, 17, 42, 184, 53/305, 329; 93/39.1 R, 39 C, 39.1 P, 55.1 R, 55.1 M, 55.1 P; 156/69, 85, 216; 229/5.5, 43

[56] References Cited

UNITED STATES PATENTS

| | | | |
|---|---|---|---|
| 2,402,943 | 7/1946 | Bogoslowsky | 156/69 X |
| 3,358,902 | 12/1967 | Emmert et al. | 229/43 |

*Primary Examiner*—Roy Lake
*Assistant Examiner*—Paul A. Bell
*Attorney, Agent, or Firm*—Roylance, Abrams, Berdo & Kaul

[57] ABSTRACT

The exposed edge of a box is covered by placing a strip of heat-shrinkable PVC around the box so that it projects axially beyond the box edge and heating the strip so that the projecting portion shrinks and bends over the box edge, covering it. The projecting portion can be made to project far enough so that, when the strip shrinks and bends, a portion protrudes inwardly beyond the box edge. That protruding portion is then pressed against the inner box wall by a fitted lid or mandrel. A second strip can then be applied in similar fashion and shrunk to form a guarantee seal between the box and lid. An end of the second strip is left free to provide a seal tearing grip.

7 Claims, 3 Drawing Figures

BOX AND METHOD OF COVERING A BOX EDGE

This invention relates to a method of forming an edge protective covering for a box and a guarantee seal therefor, and to the box thus formed.

BACKGROUND OF THE INVENTION

The covering of the edge of a box is important in the case of boxes the bodies of which are formed, for example, by cutting them from a cardboard tube, making it necessary to seal the area of cut remaining at the ends of the tube. Hitherto, this has been performed by means of a sheet metal or plastic ring, but the manufacture of such a ring, e.g., by punching out and deep drawing or by injection molding is relatively costly.

BRIEF SUMMARY OF THE INVENTION

An object of the present invention is to provide a method by which a box edge can be simply and rapidly enclosed or covered.

Briefly described the invention provides a method in which a heat shrinkable plastic foil strip is placed round the peripheral area of the box body adjacent to the box edge, and is joined therewith in such a way that part of the foil strip projects above the box edge and this projecting strip portion is heated, so that through thermal contraction or shrinking it bends inwards over the box edge at right angles to the box wall and thereby covers the said box edge.

If the box edge comprises the cut edge of a cylindrical box body, the strip portion bent inwards to produce an edge protection can be made to rest against the inner wall of the box body by fitting a cover, or by means of a mandrel, having a size corresponding to the box opening.

In one embodiment, the foil strip can connect the edge of a box cover with the box body by overlapping, and can be provided with a free end which is not connected with the box body, forming a grip for tearing away the foil strip and opening the box cover.

If the edge of the box cover is held on the box by the foil strip, a tear-open strip can be arranged beneath or as part of the foil strip by means of which the latter can be severed by opening the box cover.

BRIEF DESCRIPTION OF THE DRAWINGS

In order that the manner in which the foregoing and other objects are attained in accordance with the invention can be understood in detail, a particularly advantageous embodiment thereof will be described with reference to the accompanying drawings, which form a part of this specification, and wherein.

and

Figure 1:
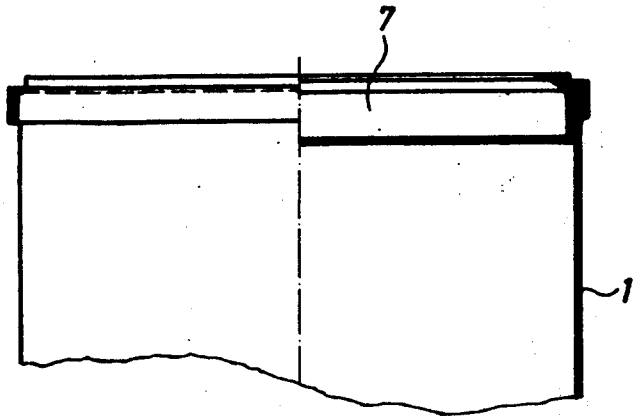
FIG. 1 is a partial side elevation, in partial section, of a box with a fitted cover.
Figure 2:
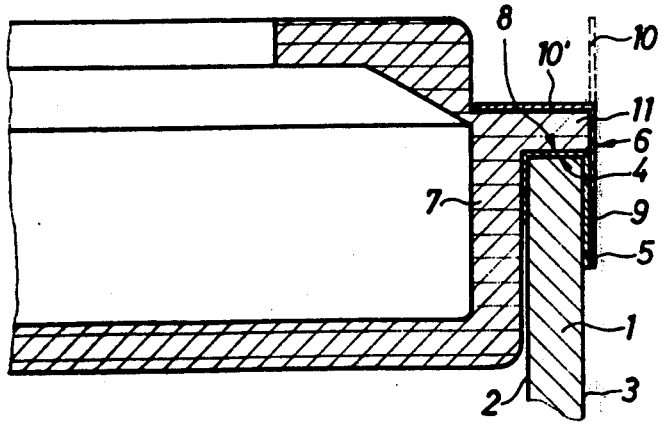
FIG. 2 is an enlarged elevation, in section, of a portion of the box of FIG. 1, illustrating the method of the invention.
Figure 3:
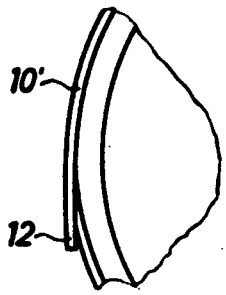

FIG. 3 is a partial plan view of the box of FIGS. 1 and 2.

DETAILED DESCRIPTION OF THE PREFERRED EMBODIMENTS

As shown in FIG. 2, the box body 1 has an inner lining 2 and outer lining 3, which form a part of the tube from which the box body was cut, the length of cut tube being in accordance with the desired box height.

As a result of the cutting process, the front exposed end 4 of the box wall has no lining, so that an edge protection must be provided.

The edge protection is produced according to the method of the present invention. To this end, a heat shrinkable plastic foil strip 5 having a suitable pressure-sensitive adhesive coating on one side thereof is placed round the box body 1 in the area of box edge 6, so that part of its width projects axially upwardly above the box edge, while its lower part is stuck to the outer lining 3 of the box body. Heat is then applied and, as a result of the heat application, the projecting strip portion contracts longitudinally (radially, with respect to the tubular box) and as a result of the diametral decrease which occurs, the projecting portion bends in that it extends horizontally inwardly over the front end 4 of the box wall and partly over the interior cross-section of the box opening. Subsequently, by means of a mandrel, selected so that its size corresponds to the box opening, or by inserting a cover 7, the strip portion protruding inwardly beyond the inner surface of the box opening can be pressed inwards into the box and consequently against the inner wall thereof, or onto the inner lining 2, where it adheres. In this way, a clean edge protection 8 is formed, preventing a penetration of cardboard particles from the area of cut or end face 4 into the product contained in the box. The strip 5 can be, for example, a polyvinyl chloride (PVC) or polyethylene tape strip which has been stretched during manufacture, primarily in the direction of its width, to provide a "memory" characteristic as is generally well known in the art, so that it shrinks when heated. The characteristics of the adhesive coating are not in themselves, critical.

After fitting cover 7, a second foil strip 9 is stuck round the box in the area of box edge 6, where its lower portion covers the remaining exterior portion of first foil strip 5, as shown in FIG. 2. Its upper portion 10, indicated in FIG. 2 by broken lines, projects upwardly over the outer flange 11 of box cover 7 and after again applying heat, it contracts so that it extends radially inwardly over the outer flange 11 or the top edge of the box formed by the outer flange. As a result box cover 7 is held onto box body 1 by strip portion 10', so that it can only be raised after removing or severing the second foil strip 9. Therefore, the second foil strip 9 forms a guarantee seal.

The outer end 12 of the second or outer foil strip 9, can be kept free from adhesive in order to form a grip, so that as shown in FIG. 3, it projects slightly from the box periphery. This can be accomplished either by removing adhesive from the end portion, by sticking a small piece of similar material onto the end, or by doubling the end over. By pulling on the said strip end 12, the foil strip 9 serving as a guarantee seal can be removed and, as a result, so can the cover. The destruction of the outer lining 3, forming the label on tearing away the guarantee seal, is prevented through the second foil strip 9 resting on the first foil strip 5, which is not detached from the lining on tearing away.

To make strip end 12, serving as a grip when tearing off the strip, particularly easily visible, it can be provided with a contrasting color.

While certain advantageous embodiments have been chosen to illustrate the invention, it will be understood by those skilled in the art that various changes and modifications can be made therein without departing from the scope of the invention as defined in the appended claims.

What is claimed is:

1. A method of covering the exposed edge of a box having an open end comprising the steps of placing a heat-shrinkable adhesive plastic foil strip around the peripheral area of the open end of the box adjacent to the box edge with a portion of the width of the foil strip projecting beyond the box edge; and heating the projecting portion of the strip to cause the projecting portion to shrink and to bend inwardly over the box edge substantially at a right angle to the box wall and to thereby cover the box edge.

2. A method according to claim 1 wherein the foil strip is placed around the box so that the projecting portion exceeds the width of the box wall and so that, upon shrinkage, the projecting portion extends inwardly beyond the inner wall of the box;

the method further comprising the step of inserting into the open end of the box a body shaped and dimensioned to be matingly received in the open end to press the inwardly extending portion of the strip against the inner wall of the box.

3. A method according to claim 2 wherein the body is a mandrel.

4. A method according to claim 2 wherein the body is a box lid.

5. A method according to claim 4 which further comprises placing a second heat-shrinkable plastic foil strip around the peripheral area of the open end of the box and the first strip with a portion of the width of the strip projecting axially beyond the lid; and heating the projecting portion of the second strip to cause the projecting portion thereof to shrink and bend inwardly, thereby covering the edge of the lid.

6. A method according to claim 5 wherein an end of the second strip is permitted to protrude from the box to form a grip to tear away the second strip.

7. A method according to claim 6 wherein the second strip apart from the grip end is adhesively attached to the box.

* * * * *